United States Patent [19]

Nebon et al.

[11] Patent Number: 5,029,301

[45] Date of Patent: Jul. 2, 1991

[54] LIMITING CIRCUIT BREAKER EQUIPPED WITH AN ELECTROMAGNETIC EFFECT CONTACT FALL DELAY DEVICE

[75] Inventors: Jean-Pierre Nebon, St. Martin Le Vinoux; Pascal Dudon, Biviers; Patrick Coudert; Robert Morel, both of Eybens, all of France .

[73] Assignee: Merlin Gerin, France

[21] Appl. No.: 544,417

[22] Filed: Jun. 27, 1990

[30] Foreign Application Priority Data

Jun. 26, 1989 [FR] France ..... 89 08589

[51] Int. Cl.[5] ..... H01H 75/00

[52] U.S. Cl. ..... 335/16; 335/195; 335/167; 200/144 R

[58] Field of Search ..... 335/16, 196, 167, 169, 335/170, 142, 195, 168; 200/144 R, 147 R

[56] References Cited

U.S. PATENT DOCUMENTS

| | | | |
|---|---|---|---|
| 3,754,108 | 8/1973 | Marot et al. | 335/170 |
| 4,042,895 | 8/1977 | Wafer et al. | 335/195 |
| 4,408,111 | 10/1983 | Domhan et al. | 335/167 |
| 4,910,485 | 3/1990 | Bolongeat-Mobleu | 335/195 |

*Primary Examiner*—Leo P. Picard
*Assistant Examiner*—Lincoln Donovan
*Attorney, Agent, or Firm*—Parkhurst, Wendel & Rossi

[57] ABSTRACT

A limiting circuit breaker comprises an electrodynamic repulsion contact system, and an electromagnetic latch arranged in the vicinity of the contact system, and electrically insulated from the latter. Actuation of the latch to the active position results from the action of the electromagnetic field due to a short-circuit current flowing in the pole, so as to temporarily keep the movable contact open after repulsion. The latch is equipped with a pair of ferromagnetic brackets, and with a spring blade to return to an inactive position.

10 Claims, 5 Drawing Sheets

LIMITING CIRCUIT BREAKER EQUIPPED WITH AN ELECTROMAGNETIC EFFECT CONTACT FALL DELAY DEVICE

BACKGROUND OF THE INVENTION

The invention relates to a limiting circuit breaker with a molded insulating case, comprising in each pole:

an electrodynamic repulsion contact system having a conducting support arm equipped with a first contact, and a movable contact having at least a second contact cooperating in the closed position with the first contact, said movable contact being driven to the open position by electrodynamic forces generated during a first repulsion phase after the current has exceeded a preset threshold, and an electromagnetic anti-fall latch capable of occupying an active position to temporarily keep the movable contact open after repulsion.

An electromagnetic anti-fall latch for a limiting circuit breaker is already known from the documents U.S. Pat. No. 4,409,573, DE-OS No. 1,463,310 and FR-A No. 2,272,479. Actuation of the latch to the active position results from the intervention of electromagnetic attraction forces generated by a strong current flowing in the pole.

According to the document U.S. Pat. No. 4,409,573, the latch is formed by a latching blade capable of cooperating with a notch provided at one of the ends of the movable contact arm on the bar side. The distance between the latch and the contact parts between which the arc is established makes it necessary to fit a steel ring surrounding the bar to strengthen the electromagnetic attraction effect on the latch.

The latching effect of the movable contact in the repelled position has the drawback of preventing any possibility of selectivity in the circuit. Unlatching is achieved by rotation of the bar after tripping of the mechanism.

Another anti-fall device (see document U.S. Pat. No. 4,612,430) uses a different technique implementing the acceleration of the movable contact when electrodynamic repulsion occurs to act initially by mechanical effect on the latch, which is then completely attracted to the active position by magnetic attraction.

The object of the invention consists in improving the achievement of an electromagnetic anti-fall latch for a limiting circuit breaker.

SUMMARY OF THE INVENTION

The electromagnetic latch surrounds the support arm in the vicinity of the first and second contacts, and comprises bearing means in the form of ramps urging the latch to an inactive position due to the return effect of the movable contact. Such an arrangement of the latch close to the contacts provides the maximum electromagnetic attraction as soon as the arc originates after electrodynamic repulsion of the contacts. This results in the latch moving at high speed to the active position, and the presence of the ramps delays the fall of the movable contact during the tripping phase of the mechanism without causing definitive latching in the repelled position. The delaying effect of the latch enables the selectivity threshold of the circuit breaker to be raised.

The latch is electrically insulated from the support arm by an insulating coating.

In a first embodiment, the electromagnetic latch comprises a magnetic circuit formed by a pair of semi-mobile brackets arranged symmetrically with respect to the pole mid-plane so as to define a first lower air-gap and a second upper air-gap, each bracket being housed in an insulating shield and having an extension shaped as a retaining ramp, on which the movable contact bears in the active position of said latch.

Arc pinching takes place in the upper air-gap when the latch is in the active position.

After the arc has been extinguished, the electromagnetic attraction effect disappears, and the latch is urged to an inactive position. The retaining ramp of each bracket has a preset inclination with respect to the mid-plane which contributes to clearing the latch to the inactive position due to the action of the return force of the movable contact.

Each bracket comprises a first polar face separated from a second polar face by a semi-open notch framing the upper branch of the loop of the support arm when the latch is actuated to the active position.

According to a second embodiment, the electromagnetic latch comprises a fixed U-shaped magnetic circuit and a pivoting blade urged by a return spring in engagement against the polar face of the magnetic circuit.

BRIEF DESCRIPTION OF THE DRAWINGS

Other advantages and features will become more clearly apparent from the following description of two illustrative embodiments of the invention, given as non-restrictive examples only and represented in the accompanying drawings, in which.

DESCRIPTION OF THE PREFERRED EMBODIMENT

Figure 1:
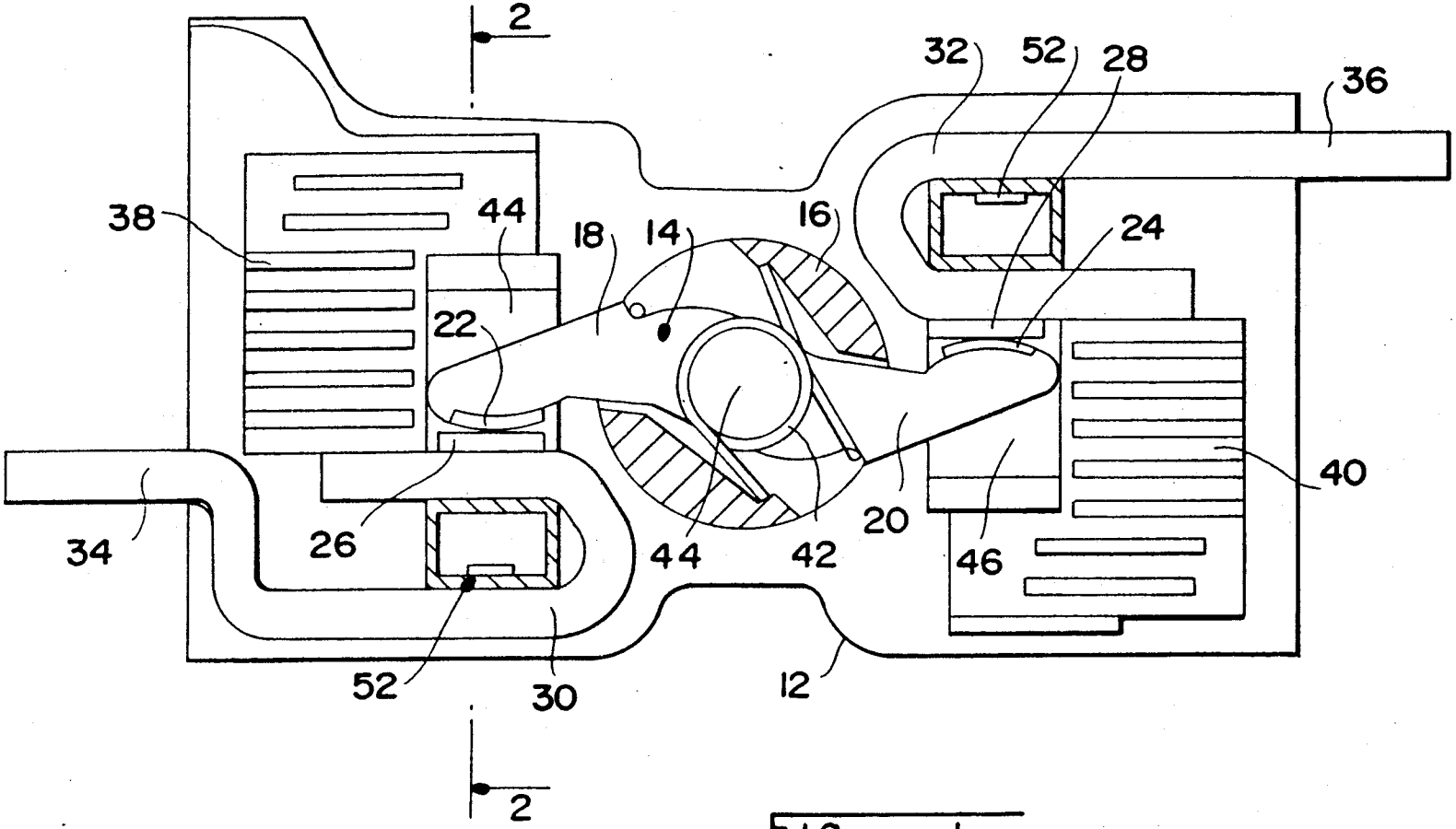
FIG. 1 is a schematic sectional view of a double-break limiting circuit breaker pole equipped with two latches with electromagnetic latching according to the invention, the circuit breaker being represented in the closed position.

In FIG. 1, a breaking pole 10 of a multipole limiting circuit breaker, with a molded insulating case 12, comprises a doublebreak rotating contact 14. The centre part of the rotating contact 14 is mounted in a housing of a rotating switching bar 16, common to all the poles. The general structure of the pole 10 is described in French Patent application No. 87 14964 filed on 10/26/1987.

The rotating contact 14 comprises a pair of opposite lever arms 18, 20, each having at their ends a contact part 22, 24 cooperating with a stationary contact 26, 28 in the form of a pad.

Each stationary contact 26, 28 is securedly united to the internal end of a loop-shaped or U-shaped arm 30, 32 made of conducting material. Electrical connection of the pole 10 is achieved by means of two connecting terminal strips 34, 36 arranged at the external ends of the support arm 30, 32 passing through the insulating case 12.

The rotating contact 14 and the two support arms 30, 32 constitute the active parts made of copper.

Two arc extinguishing chambers 38, 40 arranged on each side of the bar 16 are associated with the pairs of contacts 22, 26; 24, 28. A spring system 42 enables the contact pressure to be obtained in the closed position of the movable contact 14.

The rotating bar made of insulating material is rotationally mounted around a spindle 44 between a first and a second position corresponding respectively to closing and normal opening of the contacts. The spindle 44 extends in the middle area of the case 12, perpendicular to the plane of FIG. 1. The bar 16 acts as the driving part of all the rotating contacts 14 of the different circuit breaker poles, and is coupled to the operating mechanism (not shown) which is actuated manually by a handle and automatically by a selective trip device.

Operation of a limiting circuit breaker of this kind is well-known to those specialized in the art, and requires only a brief description:

A short-circuit current of an intensity exceeding a preset threshold occurring in the pole 10 generates electrodynamic repulsion forces between the contacts 22, 26; 24, 28. This results in the movable contact 14 moving at high speed to the open position, before the mechanism operates having received a tripping order from the trip device. The bar 16 remains immobile in the first position (FIG. 1) during this first electrodynamic repulsion phase, and only the rotating contact 14 is moved to the open position to draw a double arc between the contacts 22, 26; 24, 28, enabling a large current limiting effect to be obtained. The arc is extinguished in a conventional manner in the chambers 38, 40.

Rotation of the bar 16 to the second position takes place when the response time of the mechanism has elapsed, so as to confirm final opening of the circuit breaker. This rotation movement of the bar 16 takes place during a second mechanical actuation phase of the mechanism, which takes over from the first repulsion phase.

The first phase is not operational when the intensity of an overload current is lower than the repulsion threshold. The current limiting effect does not exist in this case, and it will be necessary to wait for operation of the bar 16 after tripping of the mechanism to bring about normal automatic opening of the circuit breaker.

To prevent automatic reclosing of the movable contact 14 during the first electrodynamic repulsion phase, an anti-fall system has to be fitted allowing temporary locking of the movable contact 14 in the open position, either until the arc has been extinguished or until the bar 16 operates after tripping of the mechanism.

According to the invention, the anti-fall system of the movable contact 14 of each pole comprises a pair of electro- magnetic latches 44, 46 (FIG. 1), arranged on each side of the bar 16, in the vicinity of the corresponding pairs of contacts 22, 26, 24, 28. The structure of the two latches 44, 46 is identical, and only that of the latch 44 will be described in detail with reference to FIGS. 2 and 3.

The electromagnetic latch 44 is composed of two semi-mobile brackets 48, 50, made of ferromagnetic material, notably steel, operating in conjunction with a return spring blade 52.

The two brackets 48, 50 are U or C-shaped and are arranged facing one another and symmetrically with respect to the vertical mid-plane 54, so as to surround the upper branch of the support arm 30 at the level of the stationary contact 26. Each bracket 48, 50 comprises a first polar face 56 vertically separated from a second polar face 58 by a semi-open notch 60, capable of fitting with the lateral configuration of the support arm 30.

Opposite from the first polar face 56, each bracket 48, 50 is equipped with an extension shaped as a retaining ramp 62 with a predetermined inclination with respect to the second polar face 58.

The spring blade 52 extends in the longitudinal direction of the spindle 44 of the bar 16 and bears by its opposite ends on two pins 64, 66 belonging to the two symmetrical brackets 48, 50. The curved middle part of the spring blade 52 is disposed between the first polar faces 56 and the lower branch of the support arm 30.

The retaining ramp 62, the second polar face 58, the notch 60 and the base of each bracket 48, 50 are advantageously covered with a coating 68 of gas-generating insulating material, notably polyamide. The whole surface of the brackets 48, 50 can be coated with this insulating material, except for the first polar faces 56 delimiting the lower air-gap 70.

The semi-mobile brackets 48, 50 of the latch 44 extend in housings 72, 74 confined by two fixed symmetrical shields 76, 78 protruding out from the opposite side walls of the case 12 and cast with the latter. The presence of these dust-protection shields 76, 78 prevents balls or particles from getting behind the brackets 48, 50, and contributes to increasing the dielectric withstand of the circuit breaker.

Figure 2:
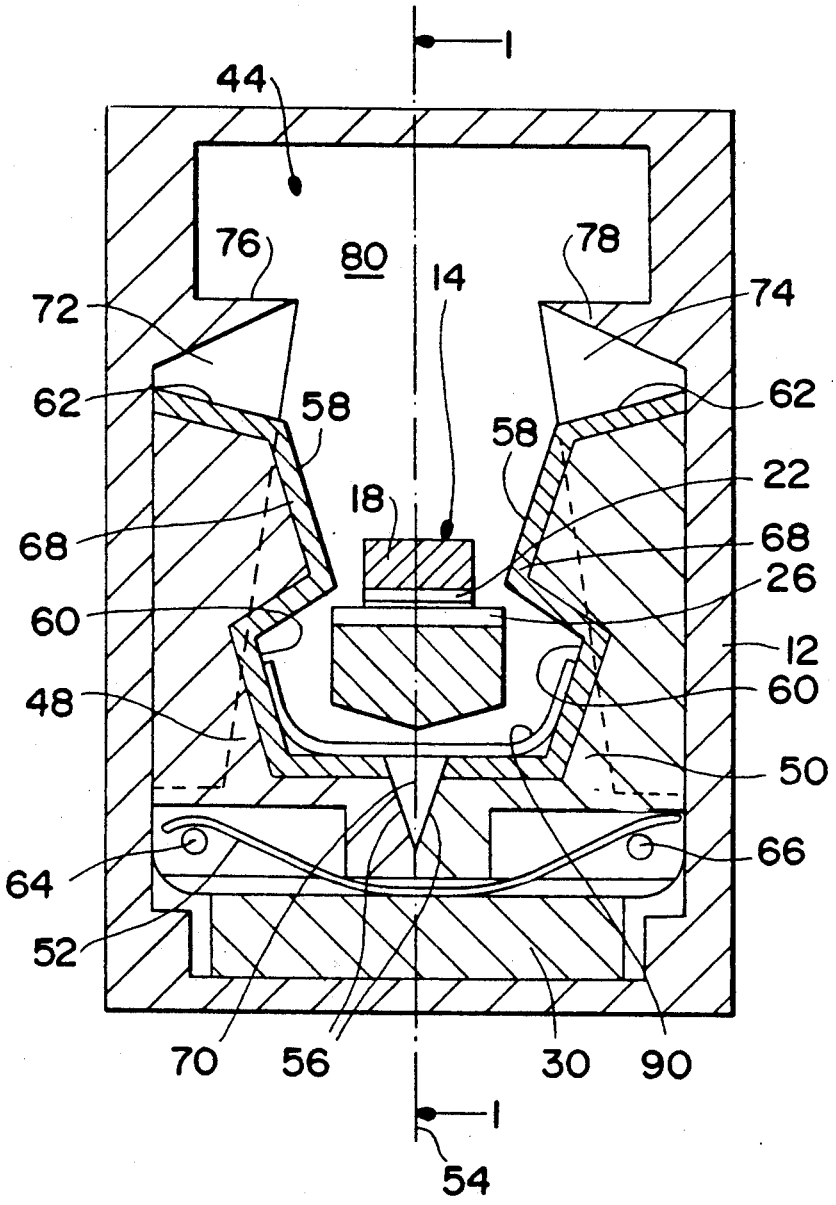
FIG. 2 is a sectional view according to the line 2-2 of FIG. 1, the latch being in the inactive position.
Figure 3:
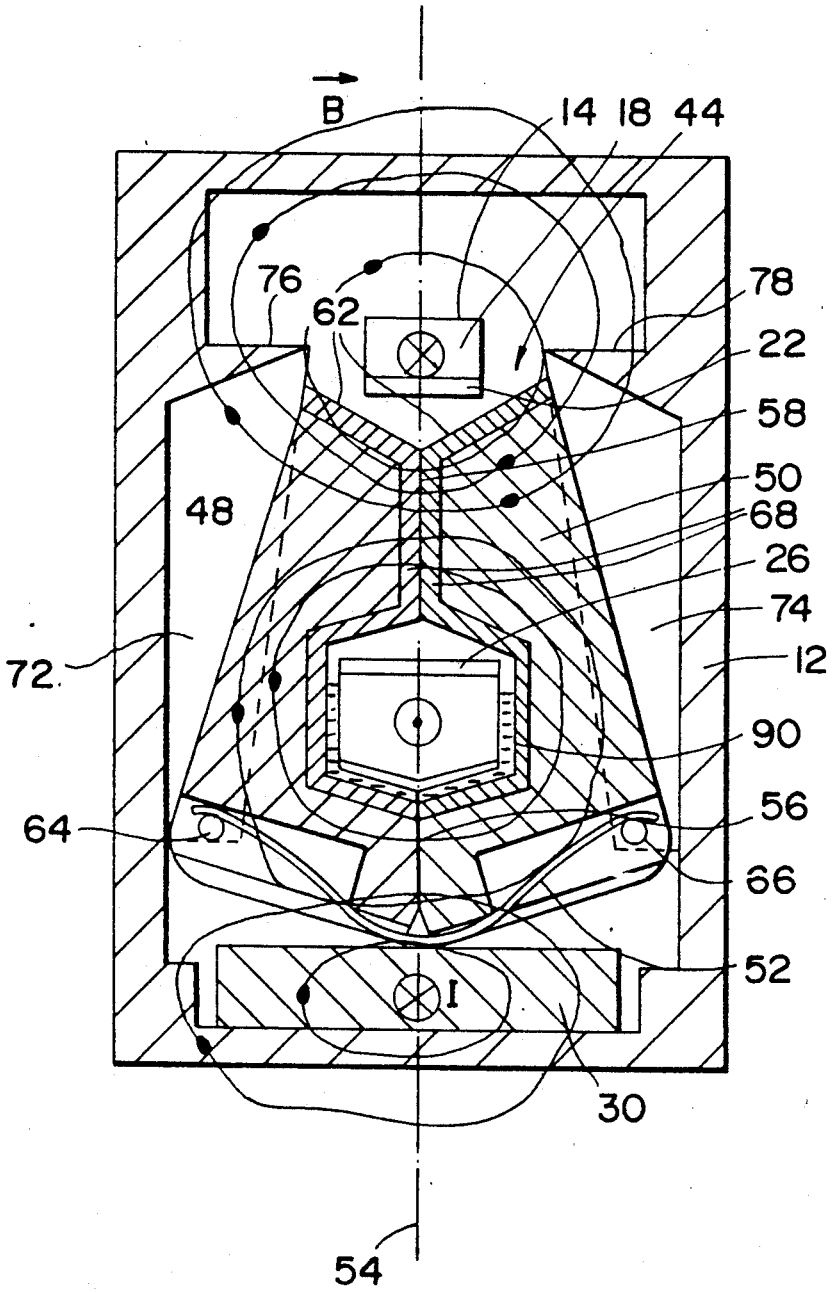
FIG. 3 shows an identical view to that of FIG. 2, in the active position of the latch.

Operation of the electromagnetic latch 44 according to FIGS. 2 and 3 is as follows:

In the closed position of the contacts 22, 26 (FIG. 2), the return spring blade 52 ensures a maximum distance between the two brackets 48, 50, which are held against the internal wall of the case 12. The latch 44 is open and is in a stable inactive position, ready to authorize free movement of the movable contact 14 when required.

When the circuit breaker is opened manually by means of the handle, the latch 44 remains immobile in the inactive position. The same is the case when automatic opening takes place by tripping of the mechanism, brought about by detection of an overload current lower than the repulsion threshold.

A strong current, notably a short-circuit current higher than said threshold, flowing in the pole 10 causes electrodynamic repulsion of the movable contact 14, which is driven during the first phase to the open position, whereas the bar 16 remains immobile in the first position. The movement of the movable contact 14 by repulsion is enhanced by the presence of the magnetic circuit formed by the two brackets 48, 50 of the latch 44. The direction of flow of the current I in the pole 10 is indicated as an example in FIG. 3, and it can be observed that this current I generates an electromagnetic field B which is closed by the lower 70 and upper air-gap 80, respectively arranged between the first polar faces 56 and between the second polar faces 58 of the latch 44. This results in the two brackets 48, 50 being brought together by the magnetic attraction forces which outweigh the opposing force of the spring blade 52. The coming together on the one hand of the first polar faces 56 and on the other hand of the second polar faces 58 keeps the latch 44 closed in an active position. The two retaining ramps 62 form a V-shaped stop, which temporarily retains the movable contact 14 when its falls back by gravity after the repulsion forces have decreased. The latch 44 is arranged to remain in the active position until the arc has been extinguished. This then results in the electromagnetic field disappearing, causing the two brackets 48, 50 to automatically scissor apart due to the return action of the movable contact 14. The movable contact 14 can then either be reclosed if the fault current was fleeting, or be held in the open position by the rotation of the bar 16 in the second position after tripping of the mechanism.

The presence of the latch 44 in the vicinity of the contacts 22, 26 provides a strong electromagnetic field to attract the two brackets 48, 50 to the active position. The brackets 48, 50 are shaped as a grip, which is closed in the active position.

The inclination of the retaining ramp 62 of the movable contact 14 contributes to moving the brackets 48, 50 apart to the inactive position of the latch 44. An acute angle is arranged between each ramp 62 and the vertical mid-plane 54. This results in progressive opening of the grip to the inactive position due to the fall-back action of the movable contact 14.

The arc is pinched in the lower air-gap 80 when the latch 44 is in the active position. The presence of the insulating coating 68 on the two brackets 48, 50 contributes to improving extinction of the arc in the chamber 38 by gas-generation effect.

The intervention of the two latches 44, 46 delays reclosing of the movable contact 14 with respect to its natural fall-back time. A deformable insulating protective strip 90, notably made of polytetrafluorethylene, is inserted between the upper branch of the support arm 30 and the notches 60 of the two brackets 48, 50 of the latch 44 to prevent balls or other metallic particles from getting into the lower air-gap 70.

Figure 4:
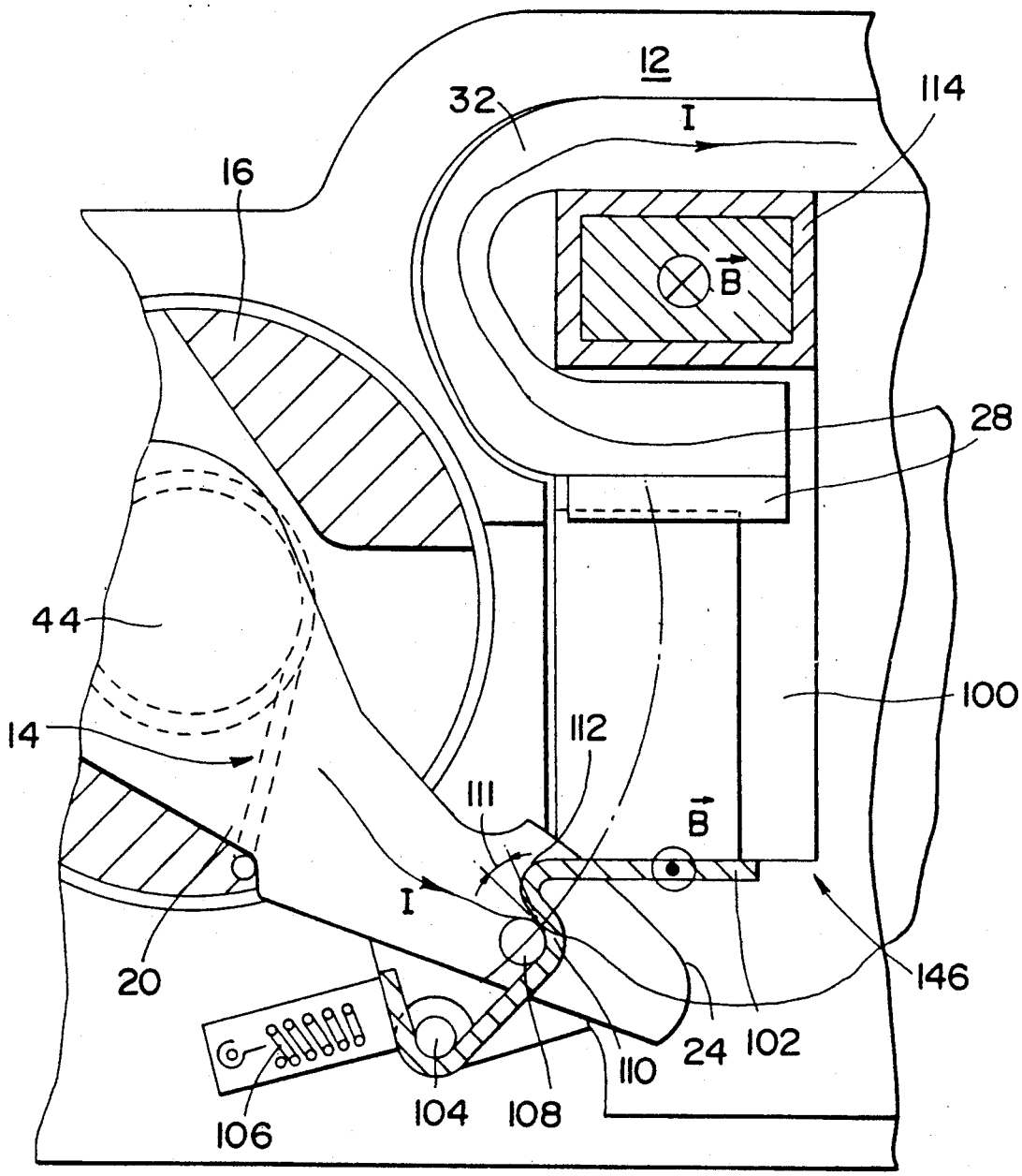
FIG. 4 represents a partial view of the circuit breaker in FIG. 1, with an alternative embodiment of the anti-fall latch.

In the alternative embodiment in FIG. 4, the same reference numbers will be used to designate identical parts to those of the device in FIGS. 1 to 3. The electromagnetic latch 146 of the movable contact 14 comprises a fixed U-shaped magnetic circuit 100, and a blade 102 articulated on a spindle 104. A spring 106, notably a drag spring, urges the blade 104 into engagement against the polar face of the magnetic circuit 100.

The lever arm 20 of the movable contact 14 is fitted with a retaining pin 108 cooperating with a latching ramp 110 located in the intermediate part of the blade 102. The oblique ramp 110 has an angle of inclination (about 10 degrees) with the normal.

In the closed position of the limiting circuit breaker, the blade 102 is applied against the magnetic circuit 100 by the return force of the spring 106. The contact part 24 of the movable contact 14 is in engagement with the stationary contact 28. The circuit 100 is covered with an insulating coating 114.

When electrodynamic repulsion of the movable contact 14 occurs, the pin 108 comes up against the blade 102, and moves it away from the polar face of the magnetic circuit 100 against the return force of the spring 106. After it has passed the neck 112, the pin 108 locates itself in the hollow of the ramp 110. The magnetic field B generated by the arcing current I then applies the blade 102 against the magnetic circuit 100 and the movable contact 14 remains blocked by the pin 108 in the open position.

When the circuit breaker closes, the bar 16 rotates counterclockwise and drives the movable contact 14 in the same direction. The angle of inclination 111 of the ramp 110 enables the blade 102 to be cleared due to the unlocking torque generated by the releasing of the contact pressure spring system 42. This unlocking torque outweighs the torque applied by the return spring 106, and the blade 106 pivots clockwise to enable the movable contact 14 to move to the closed position.

Figure 5:
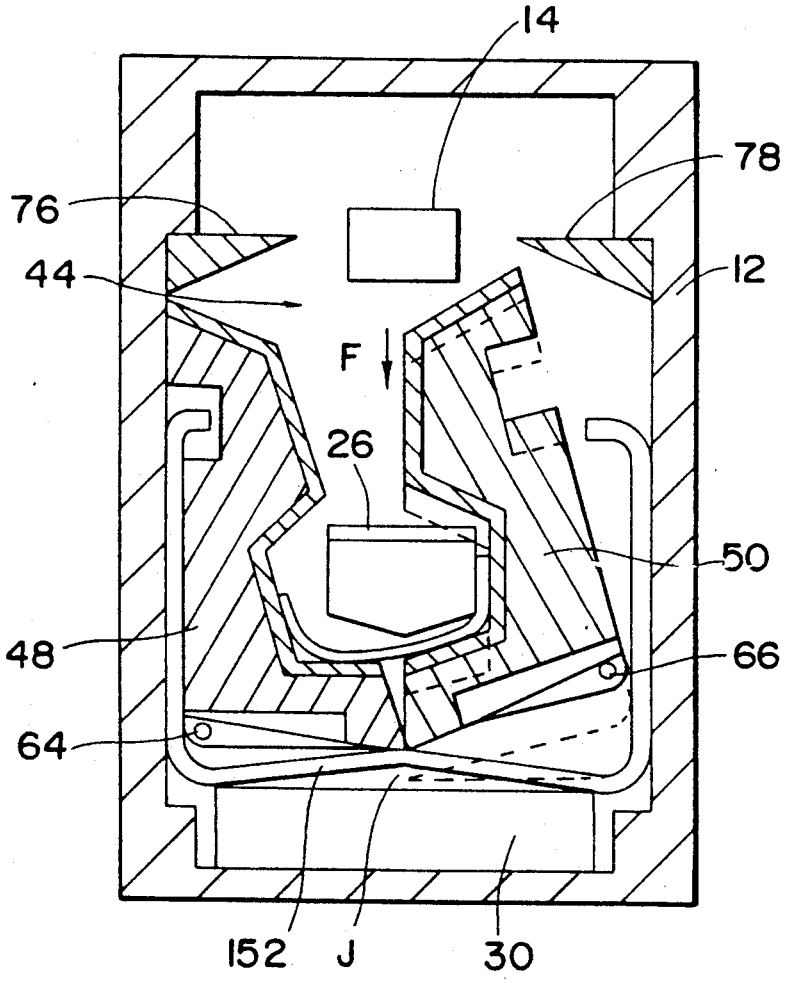
FIG. 5 is an identical view to FIG. 3 of an alternative embodiment, the left-hand half-view representing the latch in the inactive position, and the right-hand half-view showing the latch in the active position (bold lines), and in an intermediate position (dotted lines).

According to the alternative embodiment in FIG. 5, the pivoting movement of the brackets 48, 50 to the inactive position due to the return effect of the movable contact 14 after the arc has been extinguished is preceded by a downwards translation movement (see arrow F) of small amplitude. This translation movement is authorized by the presence of a clearance J between the base of the brackets, and the lower branch of the support arm 30, and of a second spring blade 152 having a curved middle part which urges the brackets 48, 50 against the upper branch of the arm 30.

These two movements of the brackets 48, 50 of the latch 44 enable the fall-back time of the movable contact 14 to be adjusted. It can be noted that the impact of the contact 14 on the ramps 62 of the brackets 48, 50 acts on the whole mass of the latch 44 during the first translation movement (see dashed line position), whereas the second rear pivoting movement which brings about unlocking acts on the upper part of the brackets 48, 50 and only involves a fraction of the mass.

The invention can also be applied to a modular limiting unit which can be coupled and electrically connected to a standard circuit breaker. The movable contact can also be single-break.

We claim:

1. A limiting circuit breaker with a molded insulating case, comprising in each pole:

an electrodynamic repulsion contact system having a conducting support arm equipped with a first contact, and a movable contact having at least a second contact cooperating in the closed position with the first contact, said movable contact being driven to the open position by electrodynamic forces generated during a first repulsion phase after the current has exceeded a preset threshold, and an electromagnetic latch controlled by the flow of current in the pole, and capable of occupying an active position to temporarily keep the movable contact open after repulsion, wherein the electromagnetic latch comprises a magnetic circuit surrounding the support arm in the vicinity of the first and second contacts, and equipped with bearing means in the form of ramps urging the latch to an inactive position due to the return effect of the movable contact.

2. The limiting circuit breaker according to claim 1, wherein the latch is electrically insulated from the support arm by an insulating coating.

3. The limiting circuit breaker according to claim 1, wherein the magnetic circuit of the ferromagnetic latch comprises a pair of semi-mobile brackets arranged symmetrically with respect to the pole mid-plane so as to define a first lower air-gap and a second upper air-gap, each bracket being housed in an insulating shield and having an extension shaped as a retaining ramp, on which the movable contact bears in the active position of said latch.

4. The limiting circuit breaker according to claim 3, an arc being drawn between the first and second contacts during the first repulsion phase, wherein the two brackets cooperate with a flexible return device urging the latch to the inactive position when the first and second contacts are in the closed position.

5. The limiting circuit breaker according to claim 4, wherein the flexible return device of the latch is formed by a spring blade having a curved middle part, and two opposite ends bearing on the brackets.

6. The limiting circuit breaker according to claim 4, wherein the retaining ramp of each bracket has a preset inclination with respect to the mid-plane which facilitates clearing of the latch to the inactive position.

7. The limiting circuit breaker according to claim 3, wherein each bracket comprises a first polar face separated from a second polar face by a semi-open notch framing the upper branch of the loop of the support arm when the latch is actuated to the active position, so as to causing a pinching effect of the arc in the second upper air-gap.

8. The limiting circuit breaker according to claim 7, wherein the second polar face is located between the retaining ramp and the semi-open notch, and the first polar face is arranged inside the loop between the upper and lower branches of the support arm, an insulating protective strip being inserted between the upper branch of the support arm and the first lower air-gap.

9. The limiting circuit breaker according to claim 1, wherein the U-shaped magnetic circuit of the electromagnetic latch comprises a pivoting blade urged by a return spring in engagement against the polar face of the fixed magnetic circuit, and the movable contact is fitted with a retaining pin cooperating with a latching ramp located in the intermediate part of the blade, said ramp having a predetermined inclination enabling the blade to be cleared when closing movement of the circuit breaker takes place.

10. The limiting circuit breaker according to claim 5, wherein the spring blade is shaped to provide a predetermined clearance between the base of the brackets and the lower branch of the support arm, to enable a first translation movement of the latch before the second pivoting movement to the inactive position due to the return effect of the movable contact.

* * * * *